US007862977B2

(12) United States Patent
Kobayashi et al.

(10) Patent No.: US 7,862,977 B2
(45) Date of Patent: Jan. 4, 2011

(54) IMAGE FORMING METHOD USING TRICKLE DEVELOPING SYSTEM, DEVELOPER USED FOR THE SAME, MANUFACTURING METHOD THEREOF, AND IMAGE FORMING APPARATUS

(75) Inventors: Makoto Kobayashi, Tokyo (JP); Yoshiyasu Matsumoto, Tokyo (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 928 days.

(21) Appl. No.: 11/695,634

(22) Filed: Apr. 3, 2007

(65) Prior Publication Data

US 2007/0238041 A1 Oct. 11, 2007

(30) Foreign Application Priority Data

Apr. 7, 2006 (JP) ..... 2006-106057

(51) Int. Cl.
*G03G 13/08* (2006.01)

(52) U.S. Cl. ..... 430/123.51; 430/108.6; 430/111.3; 430/111.35; 430/120.1; 430/122.5; 430/123.41

(58) Field of Classification Search ..... 430/120.1, 430/122.5, 123.41, 123.51, 108.6, 111.3, 430/111.35
See application file for complete search history.

(56) References Cited

U.S. PATENT DOCUMENTS

2005/0238391 A1* 10/2005 Hibino ..... 399/267

* cited by examiner

*Primary Examiner*—Mark F Huff
*Assistant Examiner*—Peter L Vajda
(74) *Attorney, Agent, or Firm*—Lucas & Mercanti, LLP

(57) ABSTRACT

A method to form an image using a trickle developing system, wherein (a) the toner comprises colorant particles with a volume median diameter of 3 to 8 μm having first inorganic particles on surfaces of the colorant particles to form toner particles; (b) the carrier comprises magnetic particles with a weight average particle diameter (D4) of 20 to 40 μm having second inorganic particles on surfaces of the magnetic particles to form carrier particles; and (c) an area ratio of element (A) based on a total area of surfaces of the carrier particles is 0.5 to 3.0 area % determined by using an X-ray analysis, provided that element (A) represents one or more elements commonly contained in the first inorganic particles and in the second inorganic particles.

5 Claims, 3 Drawing Sheets

IMAGE FORMING METHOD USING TRICKLE DEVELOPING SYSTEM, DEVELOPER USED FOR THE SAME, MANUFACTURING METHOD THEREOF, AND IMAGE FORMING APPARATUS

This application is based on Japanese Patent Application No. 2006-106057 filed on Apr. 7, 2006 in Japanese Patent Office, the entire content of which is hereby incorporated by reference.

FIELD OF THE INVENTION

The present invention relates to an image forming method using a trickle developing system, a developer to be used for the image forming method and a manufacturing method of the developer, and an image forming apparatus using the aforesaid developer, and specifically, relates to a developer for the trickle developing system, wherein a carrier is subjected to preprocessing by inorganic particles, a manufacturing method for the developer, and an image forming method and an image forming apparatus both employing the aforesaid developer.

BACKGROUND OF THE INVENTION

Though a two-component developing method has been used widely as an excellent developing method, in an electrophotographic developing method, it still has some problems even today. Among the problems, there is a strong demand for a two-component developer which can be used for a long time and their properties are constant and stabilized for their total service period.

The electrification of toner is carried out by the friction of the toner particle with the resin coated surface of the carrier. One of the problems, in particular, is that the resin-coated layer on a carrier surface in the developer is worn away and peels off after developing operations are repeated for a long time, or, a constituent of the toner sticks and coheres on the carrier surface, resulting in deterioration of the ability of the carrier to electrify the toner. In the actual developing, however, developing operations are continued under the condition where potential on a developing electrode is constant, whereby a toner-covering rate on the carrier surface in the developer is gradually reduced. Therefore, image density may be fluctuated especially in a full-color image, partial missing of an image may occur on the rear edge of a solid image caused by a relative velocity difference between a developing sleeve and a photoreceptor, or, when a halftone portion and a solid image exist together, partial missing of an image may also occur on the rear edge of a halftone image in the boundary portion between the leading edge of the solid image and a halftone portion is generated.

With the aforesaid background, there has been proposed a developing system (so-called trickle developing system, see Patent Document 1) in which, when toner is refilled corresponding to an amount consumed in the development, carrier is also added to gradually replace the carrier in the developing device, whereby the variation of the charge accumulated on the toner is suppressed and thus the developing density is stabilized.

On the other hand, in recent electrophotography, a toner having a smaller particle diameter has been widely studied in order to attain high image quality. However, there have been problems of decreased fluidity of toner particles and lack of stability in charging property of the toner, where the toner is charged due to the friction with the carrier particles. As a result, there is a tendency that the amount of added external additive is increased in order to assure the fluidity of the toner. For that reason, the amount of the transferred external additive to the carrier particles is increased while the developer is stored or is subjected to development. Accordingly, the ability of the carrier to elecrify the toner is lowered, and the difference in developing characteristics between the initial stage of developer manufacturing and after the lapse of time becomes greater. It has been often difficult to obtaining stable image quality for a long time.

In the aforesaid trickle developing method, the fluctuation of the amount of charge on the toner particles has been tried to be suppressed by gradually replacing the carrier with a fresh carrier. However, when the diameter of the toner is small, the amount of charge on the toner particles sometimes becomes smaller. This reason is considered as follow; in the case of a small diameter toner wherein the surface area per a unit volume is large, the amount of external additive to be added is large, and thereby, the amount of the external additive transferred to the newly supplied carrier is also large, resulting in the decrease in the amount of charge on the toner particles.

Specifically, when print of many sheets consuming a large amount of toner are carried out, the amounts of toner and carrier to be supplied become greater, and the amount of charge on the toner particle tends to decrease due to the transfer of the external additive to the newly supplied carrier particles, which may cause undesired image fog or unevenness in image density.

Patent Document 1 Examined Japanese Patent Application Publication No. 2-21591

SUMMARY OF THE INVENTION

An objective of the present invention is to provide an image forming method using a trickle developing system in which fluctuation of amount of charge on the toner particles is suppressed and an image free from image fog and image unevenness can be obtained, even when image forming is continued under the condition of consuming large amount of toner in a trickle developing system employing a small-diameter toner, and to provide a developer to be used for the aforesaid image forming method, a manufacturing method of the developer, and an image forming apparatus employing the developer.

One of the aspect of the present invention to achieve the above object is a method to form an image using a trickle developing system comprising the steps of: (i) forming an electrostatic latent image on a photoreceptor; (ii) developing the electrostatic latent image with a developer to form a toner image using the trickle developing system, a mixture of a toner and a carrier being refilled to a developing device in the tricle developing system when an amount of toner is decreased to a prescribed level; and (iii) transferring the toner image onto a recording sheet, wherein (a) the toner comprises colorant particles with a volume median diameter of 3 to 8 μm having first inorganic particles on surfaces of the colorant particles to form toner particles; (b) the carrier comprises magnetic particles with a weight average particle diameter (D4) of 20 to 40 μm having second inorganic particles on surfaces of the magnetic particles to form carrier particles; and (c) an area ratio of element (A) based on a total area of surfaces of the carrier particles is 0.5 to 3.0 area % determined by using an X-ray analysis, provided that element (A) represents one or more elements commonly contained in the first inorganic particles and in the second inorganic particles.

DESCRIPTION OF THE PREFERRED EMBODIMENTS

Figure 1:
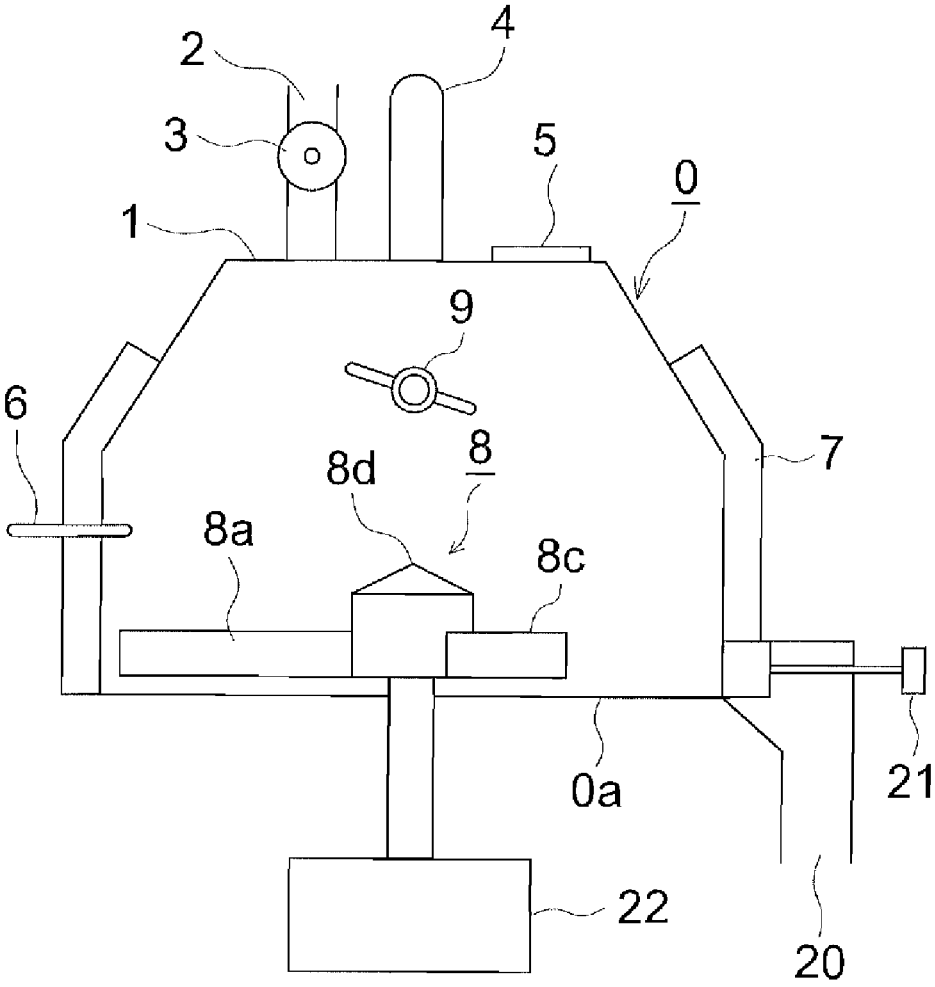
FIG. 1 is a side view of a high speed stirring and mixing machine having a stirring blade as an example of an apparatus to form a resin-covered layer on a magnetic core material in a dry process.

The above object of the present invention is achieved by the following structures.

(1) A method to form an image using a trickle developing system comprising the steps of:

(i) forming an electrostatic latent image on a photoreceptor;

(ii) developing the electrostatic latent image with a developer to form a toner image using the trickle developing system, a mixture of a toner and a carrier being refilled to a developing device in the tricle developing system when an amount of toner is decreased to a prescribed level; and (iii) transferring the toner image onto a recording sheet, wherein (a) the toner comprises colorant particles with a volume median diameter of 3 to 8 μm having first inorganic particles on surfaces of the colorant particles to form toner particles;

(b) the carrier comprises magnetic particles with a weight average particle diameter (D4) of 20 to 40 μm having second inorganic particles on surfaces of the magnetic particles to form carrier particles; and (c) an area ratio of element (A) based on a total area of surfaces of the carrier particles is 0.5 to 3.0 area % determined by using an X-ray analysis, provided that element (A) represents one or more elements commonly contained in the first inorganic particles and in the second inorganic particles.

(2) The method of Item (1), wherein element (A) is titanium.

(3) The method of Item (1) or (2), wherein an area ratio of element (A) based on a total area of surfaces of the toner particles, TA, and an area ratio of element (A) based on the total area of the surfaces of the carrier particles, CA, meet the following relationship.

$$1 \leqq TA/CA \leqq 8$$

(4) The method of any one of Items (1) to (3), wherein an amount of inorganic particles containing element (A) in the toner particles, tA (weight % based on the weight of the colorant particles), and an amount of inorganic particles containing element (A) in the carrier particles, cA (weight % based on the weight of the magnetic particles), meet the following relationship.

$$5 \leqq tA/cA \leqq 80$$

(5) A method to prepare a developer used in the method of Item (4) comprising the steps of:

(i) preparing a carrier by adding 0.005 to 0.05 weight % of inorganic particles containing element (A) based on a weight of the magnetic particles;

(ii) preparing a toner by adding 0.1 to 1.0 weight % of inorganic particles containing element (A) based on a weight of the colorant particles; and (iii) mixing the carrier prepared in step (i) and the toner prepared in step (iii) to form the developer.

(6) A developer for refill comprising a toner and a carrier, a content of the toner being 65 to 95 weight % based on a weight of the developer, wherein (a) the toner comprises colorant particles with a volume median diameter of 3 to 8 μm having first inorganic particles on surfaces of the colorant particles to form toner particles;

(b) the carrier comprises magnetic particles with a weight average particle diameter (D4) of 20 to 40 μm having second inorganic particles on surfaces of the magnetic particles to form carrier particles; and (c) an area ratio of element (A) based on a total area of surfaces of the carrier particles is 0.5 to 3.0 area % determined by using an X-ray analysis, provided that element (A) represents one or more elements commonly contained in the first inorganic particles and in the second inorganic particles.

(7) An image forming apparatus to form an image according to the method of any one of Items (1) to (4).

In the present invention, an attention is paid on the transfer of the external additive from the toner to the carrier, initial charging level of the toner is adjusted by processing initial carrier with prescribed amount of external additive, so that the same charging level is maintained even after the use for a long time, whereby the electrification characteristics are stabilized for a long time.

In the present invention, there is employed a so-called trickle developing system in which a two-component developer composed of toner and carrier is loaded in the interior of a developing unit, then, some of the two-component developer is ejected intermittently or continuously from the developing unit, and toner and carrier or the developer composed of the mixture of the toner and carrier is supplied to the developing unit, whereby fluctuation of the amount of electrification of the toner is kept small and images free from image fog nor image unevenness can be obtained, even when images consuming a large amount of toner are formed.

The present invention makes it possible to provide an image forming method using a trickle developing system in which fluctuation of amount of charge of the toner is suppressed and an image free from image fog and image unevenness can be obtained, even when image forming is continued under the condition of consuming large amount of toner in a trickle developing system employing a small-diameter toner, and to provide a developer to be used for the aforesaid image forming method, a manufacturing method of the developer, and an image forming apparatus employing the developer.

Structures of the present invention, methods to measure physical properties, methods to manufacture the toner and the carrier, and image forming apparatus to be used in the present invention will further be explained as follows.

(Characteristics of Toner and Carrier Used in the Present Invention)

For obtaining high image quality, the range of 3-8 μm is appropriate for a volume median diameter of the toner particles used in the present invention, and the volume median diameter in the range of 4-7 μm is more preferable. When the volume median diameter is 3 μm or less, sufficient fluidity of the toner may not be obtained, and for the volume median diameter of 8 μm or more, high image quality may not be sufficiently achieved.

As for the carrier particles, the weight average particle diameter (D4) is preferably in the range of 20-40 μm for obtaining high image quality in the case of using small-sized toner, and more preferably in the range of 25-37. When it is 20

μm or less, it is difficult to mix with toner appropriately, and when it is 40 μm or more, high image quality may not be expected.

The magnetic force of the carrier particles is preferably 40-70 $Am^2/g$, and is more preferably 45-60 $Am^2/g$.

(Area Ratio of Element (A) on the Surface of Carrier)

The developer employed in the present invention is a two-component developer containing toner particles having first inorganic particles on the surfaces of colorant particles and carrier particles having second inorganic particles on the surfaces of magnetic particles. When one or more elements commonly contained in the first inorganic particles and in the second inorganic particles are referred to as element (A), the area ratio of element (A) based on the total area of the surfaces of the carrier particles determined by an X-ray analysis carried out on the surfaces of carrier particles is referred to as the area ratio of element (A) on the surface of a carrier. The X-ray analysis will be described later. The area ratio of element (A) on the surface of a carrier is an indicator that indicates easiness of transfer of the inorganic particles (external additive) adhering on the surfaces of the toner particles to the surfaces of the carrier particles. The carrier in this case means carrier in the developer filled in the developing unit at the start of image forming, and carrier in the developer to be refilled in the case of trickle developing, and carrier particles after image forming are not included in the aforesaid carrier. Element (A) may be one kind of element or may be two or more kinds of elements.

If the area ratio of element (A) based on the total area of the surfaces of the carrier particles is 0.5-3.0 area %, it is possible to suppress the transfer of the external additive from the toner particle surfaces to the carrier particle surfaces, thus, the effect of reducing fluctuation of the amount of electrification on the toner particles (the amount of charge on the toner particles) can be attained. If the area ratio of element (A) is smaller than 0.5 area %, the transfer of the external additive is accelerated, resulting in a decline of the amount of electrification of the toner. On the other hand, when the area ratio of element (A) exceeds 3.0 area %, electrification ability of the carrier to electrify the toner is lowered from the beginning, resulting in the decrease of the amount of electrification on the toner particles in the beginning. Namely, it is important to control fluctuation of the amount of electrification, for obtaining stable images in the image forming for a long period of time.

The area ratio of element (A) on the carrier particles is more preferably 1.0-2.0 area %.

A method of measurement of the area ratio of element (A) by an X-ray analysis instrument is as follows.

As carrier particles used for the measurement, only carrier particles separated from fresh starter developer and/or from the developer for refill are used. The separation of the carrier particles is carried out as follows: (i) adding a small amount of neutral detergent to the developer particles in a beaker to sufficiently blend with them; (ii) adding pure water in the beaker while placing a magnet on the bottom of the beaker from outside; and (iii) removing the supernatant water, wherein above steps (ii) and (iii) are repeated several times until turbidity of the supernatant water is not recognized, thus, toner and neutral detergent are eliminated and only carrier particles are separated. After that, the carrier was dried at 40° C. to obtain carrier particles to be used for the measurement.

Area Ratio of Element (A) (ESCA)

The area ratio of the element was determined by using an X-ray analysis instrument.

Measurement:

The area ratio of the element in the vicinity of the surface of the sample for measurement was obtained by measuring with an X-ray analysis instrument ESCA-1000 (manufactured by Shimadzu Corp.).

Measurement Conditions:

X-ray intensity; 30 mA, 10 kV

Analysis Depth; Normal Mode

Element to be determined; Elements of Si, Ti, O, C and Al were subjected to quantitative analyses simultaneously, and a ratio of the element corresponding to the external additive (inorganic particles) in the total area ratio of 100% was determined as (area %).

Determination of the area ratio of element (A) on the surface of the toner particles was carried out in the same manner as the determination of the area ratio of element (A) on the surface of carrier particles using the X-ray analysis instrument. The toner particles used for the measurement was collected by putting fresh starter developer and/or developer for refill in a beaker, and adding pure water in the beaker while placing a magnet on the bottom of the beaker from outside to separate the toner particles.

(Inorganic Particles)

The area ratio of element (A) on the carrier particles is preferably in the range of 0.5-3.0 area %, and more preferably in the range of 1.0-2.0 area %.

With respect to the aforesaid inorganic particles, it is preferable to add the particles used as the external additive of the carrier into the two-component developer separately from adding to the toner. Namely, the external additive which is the same as or different from that mixed with the toner is added to the carrier, followed by stirring to mixed. The carrier processed with the external additive as described above is used in the starter developer, as well as a carrier for the refill in the trickle developing, whereby, the effect of the present invention can be obtained.

A method in which toner or carrier particles are treated with inorganic particles has been disclosed in JP-A Nos. 11-242351 and 5-303235. The purpose of the method has been to avoid the image defect caused by remarkable decline of flowability of toner due to detachment of the external additive from the toner or embedment of the external additive in the toner particle, when carrier and toner were mixed in the course of manufacturing a developer. In a word, the aforesaid purpose has been to prevent toner deterioration in the early stage, and the purpose has not been to improve a long term stability and durability of the developer by paying attention to the amount of electrification as a developer.

In the present invention, attention is paid on the area ratio of element (A), and by controlling the area ratio of element (A) within the above described range, stability of the electrification (Charge) of the developer can be maintained even external environment changes.

Examples of inorganic particles include particles of silica, titania and alumina.

Specifically, examples of commercially available silica particles include: R-805, R-976, R-974, R-972, R-812 and R-809 manufactured by Nippon Aerosil Co., Ltd.; HVK-2150 and H-200 manufactured by Hoechst AG; and TS-720, TS-530, TS-610, H-5 and MS-5 manufactured by Cabot Corp.

Examples of commercially available titanium oxide particles include: T-805 and T-604 manufactured by Nippon Aerosil Co., Ltd.; MT-100S, MT-100B, MT-500BS, MT-600, MT-600SS and JA-1 manufactured by TAYCA CORPORATION; TA-300SI, TA-500, TAF-130, TAF-510 and TAF- 510T manufactured by Fuji Titanium Inductry Co. Ltd.; and IT-S, IT-OA, IT-OB and IT-OC manufactured by Idemitsu Kosan Co., Ltd.

Examples of commercially available titanium oxide particles include: RFY-C and C-604 manufactured by Nippon Aerosil Co., Ltd. and TTO-55 manufactured by ISHIHARA SANGYO KAISHA, LTD.

The range of 10-300 nm is preferable for a particle diameter of inorganic particles, and the added amount of the inorganic particles for toner is in the range of 0.1-1.0 weight %, and preferably in the range of 0.2-0.8 weight %, and the added amount for carrier is in the range of 0.005-0.05 weight %, and preferably in the range of 0.01-0.04 weight %.

Specifically, the element (A) includes Ti, Si and Al, and among them, Ti (titanium) is especially preferable.

Further, it is preferable that $1 \leqq TA/CA \leqq 8$ represents the relationship between area ratio of element (A) of toner measured by X-ray analysis instrument: TA (area %) and area ratio of element (A) of carrier measured by X-ray analysis instrument: CA (area %), and more preferable is $2 \leqq TA/CA \leqq 6$.

Further, it is preferable that $5 \leqq tA/cA \leqq 80$ represents the relationship between added amount of inorganic particles including element (A) to toner: tA (weight %), added amount of inorganic particles including element (A) to carrier: cA (weight %), and more preferable is $20 \leqq tA/cA \leqq 60$. When there are a plurality of elements commonly contained in the first inorganic elements and in the second inorganic elements, each of TA, CA, tA, cA is represented by a sum of the corresponding values of the respective elements.

As a preconditioning method using inorganic particles of carrier, it is preferable to add an approximate amount of inorganic particles used for preconditioning of carrier, and to stir and process for a period of 0.5-1 hour with a mixer such as a tabular mixer or a V-shaped mixer.

(Measuring Method for Characteristics)

(Measurement of Volume Median Diameter (Volume D50% Diameter))

Measurement and calculation are conducted by the use of an apparatus wherein a computer system for data processing (manufactured by BECKMAN COULTER INC.) is connected to Coulter Multisizer III (manufactured by BECKMAN COULTER, INC.)

In measurement procedures, 0.02 g of toner is made to fit in with 20 ml of surfactant solution (a surfactant solution wherein a neutral detergent containing surfactant components, for example, is diluted with pure water by a factor of 10 for the purpose of dispersion of toner), and then, ultrasonic dispersion is conducted for one minute to prepare a toner-dispersed solution. This toner-dispersed solution is poured, with a pipette, into a beaker having therein ISOTONII (manufactured by BECKMAN COULTER INC.) in a sample stand, until the moment when the measurement concentration becomes 5-10%, and a measuring apparatus count is set to 2500 pieces to measure. Incidentally, an aperture diameter of 50 μm was used.

(Amount of Electrification (Charge))

An amount of electrification of toner in a developer sample of the present invention was measured by the electrification amount measuring instrument "Blow-off type TB-200" (manufactured by TOSHIBA CORPORATION).

An amount of electrification is measured by the use of a blow-off type electrification amount measuring instrument.

In the blow-off type electrification amount measuring instrument equipped with a stainless steel screen with 400 mesh (for example, TB-200: manufactured by TOSHIBA CORPORATION), nitrogen gas blows for 10 seconds under the condition of a blowing pressure of 50 kPa. An amount of electrification (μC/g) is calculated by dividing the electric charges obtained through measurement by mass of the toner that has flown away.

(Particle Diameter of Carrier)

Prearrangement:

A developers, a small amount of neutral detergent and pure water are put in a beaker to fit them in each other, and a supernatant fluid is thrown away while touching the bottom of the beaker with a magnet. Further, pure water is added and a supernatant fluid is thrown away to eliminate toner and neutral detergent and to separated only carrier. Then, the carrier is dried at 40° C. to obtain an elementary substance of carrier.

Measurement:

The carrier particles separated from the developer in the aforesaid prearrangement is photographed under the condition of a magnification of 150 times, under a scanning electron microscope, and the photographic image wherein 100 or more particles are taken in by a scanner was measured by using image processing analysis apparatus LUZEX AP (manufactured by NIRECO CORP.) to obtain a weight average particle diameter (D4).

(Carrier Related to the Present Invention)

Though a carrier which can be used in the present invention is not limited, resin-covered carrier is preferable.

As binder resin used for forming a resin-covered layer, any binder resin can be used without being limited, provided that the binder resin can form a film. However, when forming a resin film layer by a dry method described below, particles of thermoplastic resin are preferable.

As a thermoplastic resin, acrylic-ester-based polymer (including copolymer) which will be described below is preferable.

As a monomer constituting acrylate polymer, there are given compounds esterified between, for example, a group of the following monomer, acrylic acid and methacrylic acid and a group of alkyl alcohol, halogenated alkyl alcohol, alkoxyalkyl alcohol and aralkyl alcohol or alkenyl alcohol. As other resins, there are given polymers (copolymers) which are obtained from styrene and its delivertive.

Further, as a monomer which can be copolymerized with the aforesaid monomers, there are monomers such as addition polymerizable unsaturated carboxylic acids and its ester compound, aliphatic mono-olefin, conjugated diene-aliphatic diolefin, nitrogen-containing vinyl compound, vinyl acetates, vinyl ethers and vinyl silane compound, and they can be used as a copolymerization compound for the aforesaid copolymer.

Among the aforesaid monomers, acrylic acid, monopolymer of ester compound of methacrylic acid and alkyl alcohol, copolymer, and copolymer of styrene and aforesaid items are preferably used, from the viewpoint of electrification capabilities and forming capabilities for a covering layer. As an alkyl alcohol, methyl alcohol, ethyl alcohol, propyl alcohol, butyl alcohol, hexyl alcohol, cyclohexyl alcohol and t-butyl alcohol are preferable.

With respect to these acrylic acid ester type polymers having weight average molecular weight of 50000-1000000, the strength of adhesion to magnetic body particles can be enhanced, and durability of carrier can be improved.

Next, magnetic core materials constituting a carrier will be explained.

Magnetic core materials which have been known widely can be used as a magnetic core material used in the present invention, and magnetic particles of which absolute specific gravity are 3-7 g/ml like magnetite and ferrite are preferably used, since the stress applied on developers in the course of mixing and stirring in the developing unit is small, and destruction of a covering layer or fusion of toner to the carrier surface tends not to occur.

The weight average particle diameter of the magnetic core material after a resin-covered layer is provided is preferably 20-40 μm.

Next, a manufacturing method of carrier will be explained.

A frictional electrification imparting member (carrier) of the present invention can be manufactured by providing a resin-covered layer on the magnetic core material.

A resin-covered layer relating to the present invention can be provided on the magnetic core material through the known dry method or wet method (solvent coating method, solvent immersion method), in which, the dry method is preferable from the viewpoints of cost of manufacturing and of reduction of environmental burden.

The dry method is a method to provide a resin-covered layer on magnetic core materials, by heating and mixing thermoplastic resin particles (binder resin) and magnetic core materials on a dry basis by using an apparatus shown in FIG. 1.

FIG. 1 is a side view of a high speed stirring and mixing machine with a stirring blade that shows an example of an apparatus forming a resin-covered layer on the magnetic core material on a dry basis.

In FIG. 1, the numeral 0 represents a main body enclosure, 0*a* represents a bottom portion of the main body enclosure, 1 represents a main body top cover, 2 represents a material input slot, 3 represents an input valve, 4 represents a filter, 5 represents an inspection port, 6 represents a thermometer, 7 represents a jacket, 8 represents a horizontal rotating body, each of 8*a*, 8*b* and 8*c* represents a horizontal rotating body blade portion, 8*d* represents a central portion of a horizontal rotating body, 9 represents a vertical rotating body, 20 represents a product ejection path, 21 represents an ejection valve, 22 represents a motor and 23 represents a slit air blower.

The solvent coating method is a method in which a coating liquid composed of solvent-dissolved liquid of binder resin forming a resin-covered layer is coated on magnetic core material to provide a resin-covered layer.

(Two-Component Developer)

Next, the two-component based developer will be explained.

Two-component based developer relating to the present invention can be prepared by mixing carrier and toner both relating to the present invention.

With respect to a mixing ratio for carrier and toner, it is preferable that toner density comes to 1-15 mass %. As the developer used for replenishment in the trickle developing, the toner density of the developer which comes to 65-95 mass % is preferable.

As a mixing device that mixes carrier and toner, there may be used heretofore known devices such as Henschel mixer, Nauter mixer, V-shaped mixing machine and tabular mixer, and among them, Henschel mixer is preferable.

(Toner Used in the Present Invention)

Next, toner used in the present invention will be explained.

Though there is no limitation for the manufacturing method for toner particles, those manufactured by separating toner particles from the liquid through solid-liquid separation are preferable. Though the toner particle can be manufactured from any toner particle-dispersion liquid made by any of methods including a suspension polymerization method, an emulsion association method and a dissolution suspension method, those manufactured by an emulsion polymerization association method which provides sharp particle diameter distribution, excellent images and high developer life, are preferable.

A manufacturing method of toner particle-dispersion liquid by an emulsion polymerization association method will be explained as follows.

A manufacturing method of toner particle-dispersion liquid by emulsion polymerization is a method to form toner particles in water-based medium which is disclosed, for example, in Japanese Patent Publication Open to Public Inspection (hereafter referred to as JP-A) No. 2002-5112.

Further, there may be given the methods to manufacture a toner particle-dispersion liquid by salting out and fusion resin particles in water-based medium which are disclosed in JP-A Nos. 5-265252, 6-329947 and 9-15904.

Specifically, after dispersing resin particles by using emulsifiers in water, coagulators with critical coagulation density or higher are added for salting out, and simultaneously with the foregoing, a particle diameter is caused to grow gradually while forming fused particles by heating and fusing at the glass transition temperature of the formed polymer itself or higher, and then, growth of particle diameter is stopped by adding a large amount of water when the particle diameter reaches the target one, and further, a surface of a particle is smoothed to control its form while heating and stirring, to prepare the toner particle-dispersion liquid. Meanwhile, in this case, a solvent that is infinitely soluble in water such as alcohol may also be added together with the coagulator.

As water-based media, there are given, for example, water, methanol, ethanol, isopropanol, butanol, 2-methyl-2-butanol, acetone, methyl ethyl ketone, tetrahydrofuran, and a mixture of the foregoing, which, however, are not limited in particular. It is possible to select appropriate ones from the aforesaid items for manufacturing of toner.

As an organic solvent, there are given toluene, xylene and a mixture thereof, which, however, are not limited in particular.

Toner relating to the present invention is used after so-called external additives are added to toner particles for the purpose of an improvement of flowability and of upgrading of cleaning performance. These external additives are not limited in particular, and various inorganic particles, organic particles and lubricants can be used.

As inorganic particles which can be used as external additives, there are given heretofore known inorganic particles. Specifically, silica particles, titanium particles and alumina particles can be used preferably. It is preferable that these inorganic particles are hydrophobic.

As specific examples of the silica particles, there are given articles on the market R-805, R-976, R-974, R-972, R-812 and R-809 manufactured by Nippon Aerosil Co., Ltd., HVK-2150 and H-200 manufactured by Hoechst AG and articles on the market TS-720, TS-530, TS-610, H-5 and MS-5 manufactured by Cabot Corp.

As specific examples of the titanium particles, there are given, for example, articles on the market T-805 and T-604 manufactured by TAYCA CORPORATION, articles on the market MT-100S, MT-500BS, MT-600, MT-600SS and JA-1, articles on the market TA-300SI, TA-500, TAF-130, TAF-510 and TAF-510T manufactured by Fuji Titanium Inductry Co., Ltd. and articles on the market IT-S, IT-OA, IT-OB and IT-OC manufactured by Idemitsu Kosan Co., Ltd.

As alumina particles, there are given, for example, articles on the market RFY-C and C-604 manufactured by Nippon Aerosil Co., Ltd. and articles on the market TTO-55 manufactured by ISHIHARA SANGYO KAISHA, LTD.

As organic particles which can be used as external additives, there are given particles each being spherical and having a number average primary particle diameter of 10-2000 nm. As a constituent material for these organic particles, there are given polystyrene, polymethylmethacrylate and styrene-methylmethacrylate copolymer.

As a lubricant that can be used as an external additive, a metal salt of higher fatty acid can be given. Specific examples of a metal salt of higher fatty acid include stearic acid metal salt such as zinc stearate, aluminum stearate, copper stearate, magnesium stearate and calcium stearage; oleic acid metal salt such as zinc oleate, manganese oleate, ion oleate, copper oleate and magnesium oleate; palmitic acid metal salt such as zinc palmitate, copper palmitate, magnesium palmitate and calcium palmitate; linoleic acid metal salt such as zind linoleate and calcium linoleate; and recinoleic acid metal salt such as zinc recinoleic and calcium recinoleic.

As an added amount of external additives, a range of about 0.1-5 mass % for toner particles is preferable.

An apparatus for adding external additives to toner particles for mixing them, there are given various heretofore known mixing apparatuses such as a tabular mixer, a Henshel mixer, a Nauter mixer and a V-shaped mixing machine.

(Photoreceptor Used in the Present Invention)

Next, photoreceptors used in the present invention will be explained.

Photoreceptors used in the present invention are not limited in particular, and a photoreceptor having a surface protective layer wherein a conductive support has thereon an organic light sensitive layer on which an organic silicon compound is condensed that is called the so-called a silicone hard coat layer, and is described in JP-A Nos. 2003-202785 and 2003-208036, can also be used.

(Developing Method Used in the Present Invention)

Figure 2:
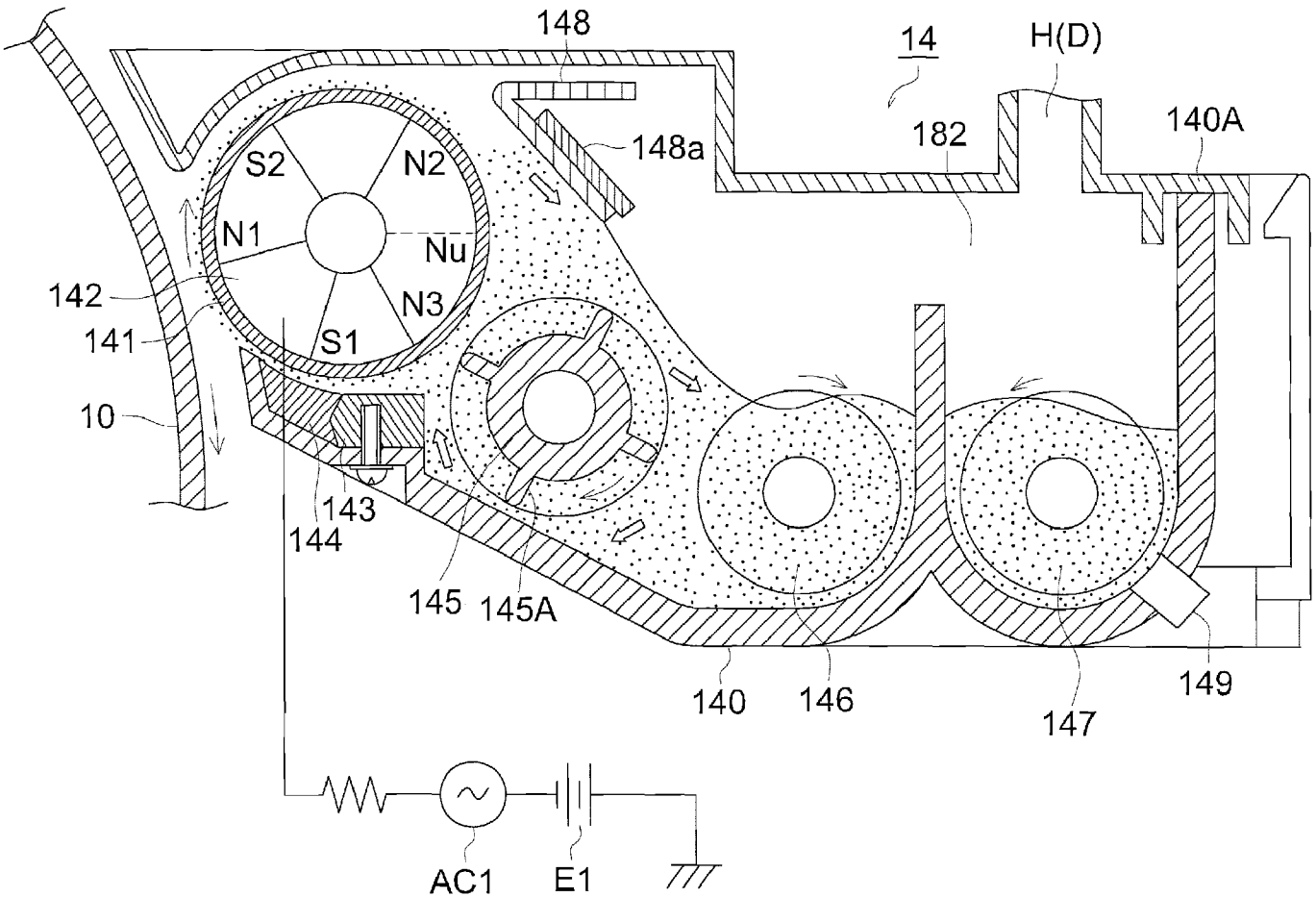
FIG. 2 is an enlarged sectional view of the developing unit.

Next, an embodiment of a developing unit of the present invention will be explained, referring to FIG. 2. FIG. 2 is an enlarged sectional view of the developing unit of the present invention. Incidentally, an arrow illustrated in FIG. 2 indicates the direction of rotation of each roller, and an outlined arrow indicates the direction of conveyance of developers.

In FIG. 2, developing unit 14 for each color of Y, M, C and K is arranged clockwise in the order of Y, M, C and K, with its developing sleeve 11 facing the light sensitive surface of photoreceptor drum 10 whose outside diameter is, for example, 100 mm.

The developing unit 14 representing a developing unit for each color is loaded with the aforesaid two-component developers respectively for yellow (Y), magenta (M), cyan (C) and black (K), and is equipped with developing sleeve 141 that rotates in the direction (clockwise direction in FIG. 2) opposite to the rotation direction (clockwise direction in FIG. 2) of the photoreceptor drum 10, while keeping the prescribed clearance for the peripheral surface of the photoreceptor drum 10.

The developing unit 14 representing a developing unit for each color is constituted as follows.

In the developing unit 14, the numeral 140 represents a developing unit housing which is a developer housing section that houses therein two-component developer composed of toner and carrier, 142 represents a magnetic roll that is a magnetic field generating means having therein a fixed magnetic pole, 141 represents a developing sleeve that is a developer conveyor having therein the magnetic roll 142, 143 represents a layer thickness regulating member that is a layer thickness regulating means composed of a magnetic material that regulates a developer layer thickness on the developing sleeve 141, 144 represents a developer catching member composed of a nonmagnetic material, 148 represents a developer-removing plate having on its back side magnetic plate 148*a*, 145 represents a conveyance-supply roller and 146 and 147 represent a pair of stirring screws.

The developing sleeve 141 representing a developer conveyor is composed of a nonmagnetic and cylindrical member having an outside diameter of 8 mm-60 mm which is made of, for example, stainless steel, and is rotated in the direction opposite to that of rotation (rotation in the clockwise direction in FIG. 2) of photoreceptor drum 10 for the peripheral surface of the photoreceptor drum 10 (rotation in the clockwise direction in FIG. 2), while keeping the prescribed clearance by unillustrated stopper rolls provided on both ends of the developing sleeve 141. When the outside diameter is not more than 8 mm, it is impossible to form magnetic roll 142 having the magnetic pole with at least 5 poles composed of magnetic poles N1, S1, N2, S2 and N3 which are necessary for image forming, while, when the outside diameter of the developing sleeve 141 exceeds 60 mm, a size of the developing unit 14 is increased. In particular, in the color printer (see FIG. 3) having plural sets of developing units 14, a space occupied by the developing units becomes large, resulting in an increase of the outside diameter of the photoreceptor drum 10, thus, the enlarged photoreceptor drum 10 makes the image forming apparatus to be large.

The magnetic roll 142 is capsuled in the developing sleeve 141 to be provided alternately with N1, N2, N3, S1 and S2, and is fixed concentrically on the developing sleeve 141, to let magnetic force to work on the peripheral surface of a nonmagnetic sleeve.

Layer thickness regulating member 143 that is a layer thickness regulating means is composed, for example, of a bar-shaped or plate-shaped magnetic stainless steel material that faces magnetic pole N3 of magnetic roll 142, and is arranged to keep a prescribed clearance from the developing sleeve 141, and it regulates a layer thickness of the two-component developer on the peripheral surface of the developing sleeve 141.

Developer catching member 144 is composed of a nonmagnetic member employing a resin member such as, for example, ABS resin, and it is arranged at the downstream side in the direction of rotation of the developing sleeve 141 to adjoin an end surface of layer thickness regulating member 143, so that, it is fixed on the layer thickness regulating member 143 with adhesives, for example to be formed integrally, and it prevents toner from falling out of the developer layer regulated by the layer thickness regulating member 143, and keeps the developer layer of two-component developer stably on the peripheral surface of the developing sleeve 141. The developer catching member 144 may also be formed by developing unit housing 140 to be provided to adjoin the end surface of the layer thickness regulating member 143.

Developer-removing plate 148 is provided to face magnetic pole N2 of magnetic roll 142, and it scrapes off developers on the developing sleeve 141 together with magnetic plate 148*a* provided on the back surface of repulsion magnetic field of magnetic poles N2 and N3 and of the developer-removing plate 148.

The conveyance-supply roller 145 conveys developers scraped off by the developer-removing plate 148 to stirring screw 146, and supplies developers stirred by the stirring screw 146 to the layer thickness regulating member 143. The symbol 145A is provided on the conveyance-supply roller 145, and it is a blade portion for conveying developers.

Stirring screws 146 and 147 rotate at the same speed respectively in the directions which are opposite to each other, and they stir and mix toner and carrier in the developing unit 14 to make them to be the two-component developer containing the prescribed toner components evenly.

The developer replenished into developing unit housing 140 through an after-mentioned toner replenishing port formed on top plate 140A that is located on the upper part of the stirring screw 147 and of the developing unit housing 140, are stirred and mixed with developers housed in developing unit housing 140 by stirring screws 146 and 147 which rotate at the same speed respectively in the directions opposite to each other, to become developers having uniform toner density. The aforesaid developers are conveyed to the layer thickness regulating member 143 by the conveyance-supply roller 145 to be of the prescribed layer thickness by the layer thickness regulating member 143, to be made to the prescribed layer thickness by the layer thickness regulating member 143, and the developer layer of the two-component developer is supplied on the outer peripheral surface of developing sleeve 141 stably. Developers used for development of latent images on the photoreceptor drum 10 are scraped off by repulsion magnetic field of magnetic poles N2 and N3 and by actions of magnetic plate 148 provided on the back surface of developer-removing plate 148, and are conveyed to the stirring screw 146 again by conveyance-supply roller 145. Electrostatic latent images on the photoreceptor drum 10 are developed reversely through a non-contact developing method by application of developing bias voltage in which alternate current (AC) bias AC1 is superposed by direct current (DC) bias E1 in case of need.

Though a developing unit used for the image forming apparatus of the present embodiment has an excellent characteristic that the non-contact developing method can conduct easily development of high image density having no photographic fog, it is preferable to use the following two-component developer for developing clear images which are free from photographic fog.

A two-component developer composed of nonmagnetic toner having heretofore average particle diameter of ten-odd microns and of magnetic carrier having average particle diameter of several tens of microns—several hundred microns have been used for the developing unit. However, as developers used in the present invention, the two-component developer composed of toner having volume median diameter of 3-8 μm, preferably of 4-7 μm and of carrier having weight average particle diameter of 20-40 μm, more preferably of 25-37 μm are used, because control of transfer of toner can be conducted effectively by using an oscillation electric field.

For the developing unit 14, developer D is supplied. When toner density detection sensor 149 detects that the toner density in the developer unit housing 140 is declined to be lower than the prescribed toner density, developer D is supplied. Developer to be supplied is replenished into developing unit 14 through developer conveyance path 300 from hopper 200D representing a means to supply developer D. Conveyance screw 300A is provided inside the developer conveyance path 300 to convey developer D.

Replenishing port H (D) of the developer conveyance path for conveying developer D is formed on the surface located on the end portion at the upstream side of conveyance of stirring screw 147 on the aforesaid top plate 140A. By such an arrangement, developer D to be newly replenished is sufficiently stirred in the circulating conveyance process by stirring screws 146 and 147, and the toner thus stirred is charged by stirring and is conveyed to developing sleeve 141 to be supplied.

Though an amount of toner in developer D replenished from hopper 200D approximates to that of the toner consumed by developing, the carrier in developer D replenished from hopper 200D is not consumed. Therefore, an amount of developer in developing unit housing 140 is increased by replenishment of developer D. To overcome this problem, there is provided an ejection means explained below which ejects two-component developer D of which amount is increased to the excessive level against the prescribed amount in developer housing 140.

If the amount of the two-component developer in the developing unit housing 140 is increased to raise the surface level, an unillustrated surface level detecting means for detecting the surface level detects that the two-component developer is in the excessive level, and the conveyance-drive motor is switched so that the stirring screws 146 and 147 rotate in directions which are opposite to those in ordinary developing. By this operation, the developer is ejected and conveyed to developer recovery box 400 provided on the lower part of the image forming apparatus by conveyance screw 300B. The developer in the developing unit housing 140 is ejected by the operations stated above, and when the surface level detecting means detects that the developer is reduced to the standard level, the inverse rotations of the stirring screws 146 and 147 are returned to the regular rotations.

The image forming apparatus of the present embodiment has a developer supply mode that supplies developer to developing unit 14 during the above-mentioned printing operations depending on the state of image forming, a developer supply mode that supplies the developer to developing unit 14 before operating the developing unit, and a developer ejection mode that ejects developers from developing unit 14 after operation of the developing unit.

The two-component developer is not contained at all in developing unit housing 140 of developing unit 14 before newly installing an image forming apparatus, namely, before operating a developing unit. The developer supply mode is selected prior to image forming, and a two-component developer in appropriate quantity having an appropriate toner ratio is filled in the developing unit housing 140. A user loads developer D in hopper 200D which is a developer loading section, and selects a developer supply mode (not illustrated). Then an appropriate amount of appropriate two-component developer is supplied to developing unit housing 140. Since an amount of developer D supplied by a single turn of supply roller SRD is substantially constant, the two-component developer in an appropriate amount having an appropriate toner ratio is supplied into developing unit 14 in developing unit housing 140 through conveyance path 300 to set the condition for excellent developing.

It is further possible to arrange a program to stop the supply of the two-component developer when a surface level detecting means detects that the two-component developer has been supplied in prescribed quantity, instead of supplying a fixed amount of two-component developer.

After printing operations, for example, for several tens of thousands of prints, when the two-component developer in developing unit housing 140 need to be ejected totally for the purpose of replacement, a user selects a developer ejection and ejection of the two-component developer housed in developing unit housing 140 is conducted. In the present embodiment, a conveyance-drive motor that drives stirring screws 146 and 147 is inversely rotated, and conveyance screw 300B is also rotated. The two-component developer in developing unit housing 140 is dropped by the inverse rotation of the stirring screw 147, and the two-component developer thus dropped are conveyed by conveyance screw 300B to be recovered in developer recovering box 400. In developing unit 14, the two-component developer inside the developing unit 14 is ejected totally when inverse rotation of stirring screw 147 is continued, because the stirring screw 147 is in a form to be located at the lowest position in the developing unit housing as shown in a sectional view in FIG. 2.

The control of the developing unit 14 explained above is conducted independently for each of developing units 14 for Y, M, C and K in the case of a color printer.

In the present invention, easy mounting and dismounting of a developing unit are not necessarily required, because supply of the two-component developer to a developing unit and ejection of the two-component developer are carried out under the condition that the developing unit is set on an image forming apparatus, although the developing unit has been needed to be unitized so that it may easily be dismounted from an image forming apparatus.

When the control of supply and ejection of developers explained in the embodiment generates excellent effects when it is applied to a developing unit such as a color printer. Even when the control is applied to developing unit 14 of a color image forming apparatus of a tandem type shown in FIG. 3, the same effects are generated. Therefore, the color image forming apparatus of a tandem type of this kind will be explained.

(Image Forming Method and Image Forming Apparatus)

Figure 3:
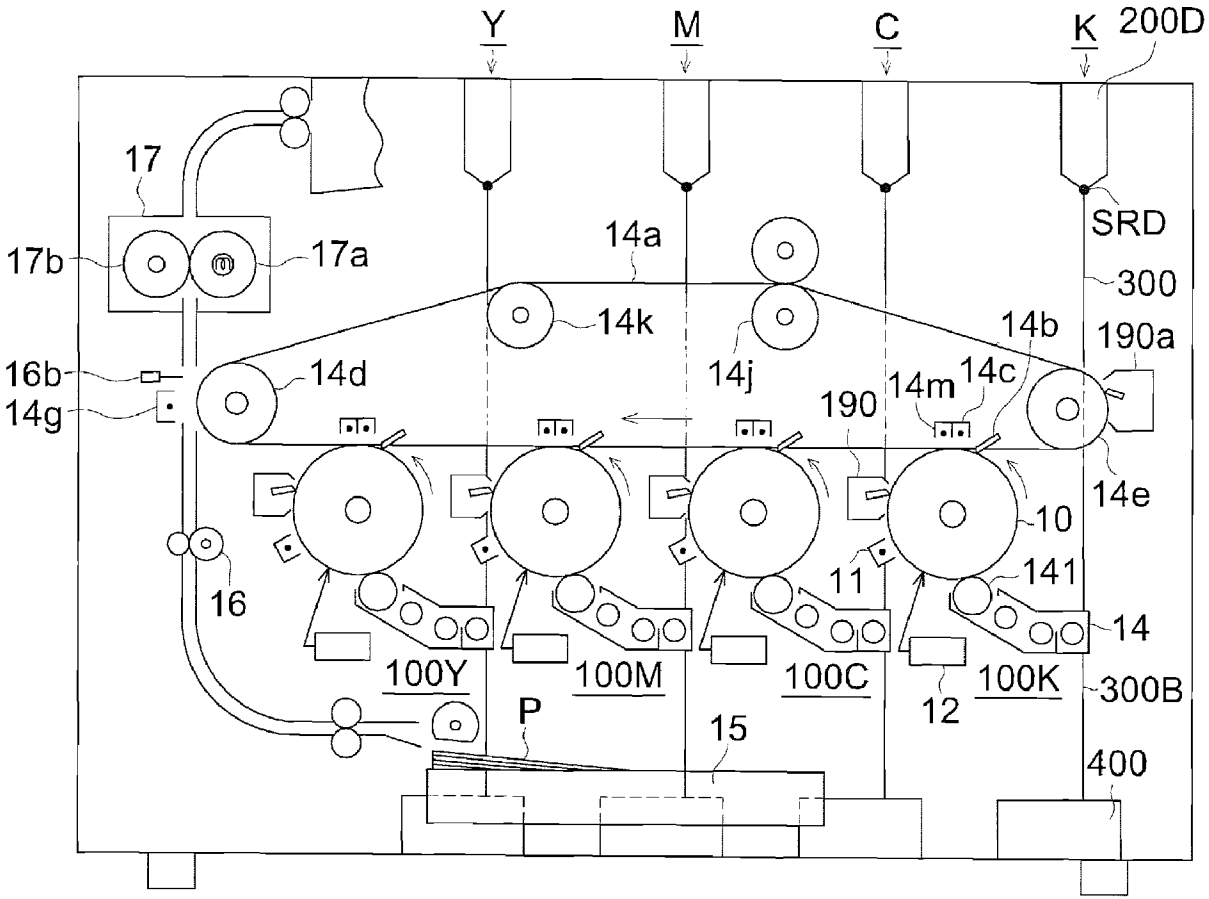
FIG. 3 is a sectional view of a color image forming apparatus equipped with a developing unit of the present invention.

The color image forming apparatus shown in FIG. 3 is a color image forming apparatus of a tandem type, wherein a plurality of image forming bodies are arranged in parallel, and their structures and functions are as follows. On the marginal portions of transfer belt 14*a* representing an intermediate transfer body, there are provided four sets of process units 100 which are respectively in yellow (Y), magenta (M), cyan (C) and black (K), and toner images respectively of Y, M, C and K each being a single color formed by each process unit 100 are transferred to be superposed on transfer belt 14*a*, and transferred color toner images are transferred collectively on a recording sheet representing a transfer material, to be fixed and ejected outside the apparatus in the structure.

The numeral 10 represents a photoreceptor drum representing an image forming body for each color, 11 represents a scorotron charger representing a charging means for each color, 12 represents an exposure optical system representing an image writing means for each color, 14 represents a developing unit for each color, and 190 represents a cleaning device representing a cleaning means for photoreceptor drum 10 for each color.

Photoreceptor drum 10 representing an image forming body for each color is one wherein an organic photoreceptor layer (OPC) having on its surface an over-coat layer (protective layer) is formed on an outer circumferential surface of a cylindrical metal base body that is made, for example, of aluminum, and as stated later, it receives driving force from transfer belt 14*a* when the transfer belt 14*a* under the state of contact moves to be driven to rotate, thus, the photoreceptor drum 10 for each color is rotated in the direction shown by an arrow in the figure, under the state of grounding.

The organic photoreceptor layer is made to be a two-layer structured photoreceptor layer wherein functions are separated to a charge generating layer (CGL) whose main component is a charge generating material (CGM) and to a charge transport layer whose main component is a charge transport material (CTM). Incidentally, the organic photoreceptor layer may also be of a single layer structure wherein a charge generating material (CGM) and a charge transport material (CTM) are contained in a single layer, and binder resins are usually contained in a photoreceptor layer of a single layer structure or in a photoreceptor layer of the aforesaid two-layer structure.

Scorotron charger 11 representing a charging means for each color conducts charging actions (negative charging in the present embodiment) by control grids each being kept to prescribed electric potential and by corona discharge having the same polarity (negative polarity in the present embodiment) as that of toner (toner in the case of developing) used by corona discharge electrode, and gives uniform electric potential to photoreceptor drum 10. As a corona discharge electrode of scorotron charger 11, it is also possible to employ other electrodes such as a serrated electrode and a needle electrode.

Exposure optical system 12 representing an image writing means for each color is arranged on the circumference of photoreceptor drum 10 in a way that an exposure position on the photoreceptor drum 10 may come to the downstream side in the rotation direction of the photoreceptor drum 10 for the scorotron charger 11 for each color mentioned above. The exposure optical system 12 gives image-wise exposure to a photoreceptor layer of the photoreceptor drum 10 in accordance with image data of each color acquired through reading by a separate image reading device and through storing in a memory, and forms an electrostatic latent image on photoreceptor drum 10 for each color.

Developing unit 14 representing a developing means for each color has developing sleeve 141 formed by cylindrical and nonmagnetic stainless steel material or aluminum material having a thickness of 0.5-1 mm and an outside diameter of 15-25 mm that rotates in the forward direction for the rotating direction of photoreceptor drum 10 while keeping a prescribed clearance from a circumferential surface of photoreceptor drum 10 as explained before by using FIG. 2, and it houses therein each of the two-component developers respectively for yellow (Y), magenta (M), cyan (C) and black (K), according to a color of developing for each color. The developing unit 14 is kept by unillustrated stopper rolls to be away from photoreceptor drum 10 by a prescribed clearance, for example, of 100-500 μm, and when direct-current voltage or developing bias voltage in which direct-current voltage and alternating voltage are superposed each other is applied on the developing sleeve 141, the developing unit 14 conducts contact type reversal developing to form a toner image on photoreceptor drum 10 by causing developers carried on a circumferential surface to be bristles.

On the photoreceptor drum 10 charged evenly by scorotron charger 11, there is conducted image-wise exposure by exposure optical system 12 to form an electrostatic latent image which is developed by the developing unit 14 to become a toner image. At a transfer position, this toner image is transferred onto transfer belt 14*a* which will be explained later. Toners remaining on the drum after transfer operations are removed by cleaning device 190 that conducts collection electrostatically for cleaning.

Transfer belt 14*a* toward which the process units 100 respectively for four colors of Y, M, C and K face in parallel is an endless belt having specific volume resistance of $10^{12}$-$10^{15}$ Ω·cm, and it is a two-layer structured seamless belt wherein fluorine coating with thickness of 5-50 μm is provided as a toner filming preventive layer preferably, on the outside of a semiconductive film base having thickness of 0.1-1.0 mm in which conductive materials are dispersed in engineering plastic such as, for example, modified polyimide, thermocurable polyimide, ethylene-tetrafluoroethylene copolymer, polyvinylidene fluoride and nylon alloy. As a base of the transfer belt 14*a*, a semiconductive rubber belt having thickness of 0.5-2.0 mm in which conductive materials are dispersed in silicone rubber or urethane rubber can also be used. The transfer belt 14*a* is trained about drive roller 14*d*, driven roller 14*e*, tension roller 14*k* and backup roller 14*j* on a circumscribing basis, and in the case of image forming, the drive roller 14*d* is driven by an unillustrated drive motor to rotate, then, the transfer belt 14*a* is pushed against photoreceptor drum 10 by pressing elastic plate 14*b* arranged at the upstream side of the transfer position for each color, and the transfer belt 14*a* is rotated in the direction shown with an arrow in the drawing. In this case, the photoreceptor drum 10 is driven to rotate by driving force of the transfer belt 14*a* caused by the transfer of the transfer belt 14*a*.

Primary transfer device 14*c* representing a transfer means for each color is constituted preferably with a corona discharge, and it is provided to face photoreceptor drum 10 for each color with the transfer belt 14*a* between, to form a transfer area (having no sign) for each color between the transfer belt 14*a* and photoreceptor drum 10 for each color. By forming a transfer electric field on the transfer area by applying, on the primary transfer device 14*c* for each color, the direct-current voltage with polarity opposite to that of toner (positive polarity in the present embodiment), a toner image on the photoreceptor drum 10 for each color is transferred onto the transfer belt 14*a*.

Neutralizing device 14*m* representing a neutralizing means for each color is constituted preferably with a corona discharger, and it neutralizes transfer belt 14*a* charged electrically by the primary transfer device 14*c*.

Pressing elastic plate 14*b* representing a pressing means for the transfer belt is formed with a rubber blade such as urethane to be arranged at the upstream side of the transfer position for each color, and it presses the transfer belt 14*a* against photoreceptor drum 10 to rotate photoreceptor drum 10, following the movement of the transfer belt 14*a*.

At the start of image recording, photoreceptor drum 10 of image forming unit 100 for black (K) is rotated in the direction shown by an arrow in the drawing, by the start of an unillustrated photoreceptor drive motor, and at the same time, charging operations of scorotron charger 11 start giving potential to photoreceptor drum 10 for K.

After potential is given to the photoreceptor drum 10 for K, image writing by electric signals corresponding to the first color signals, namely, to image data of K is started by exposure optical system 12 of K, and an electrostatic latent image corresponding to the image of K of document image is formed on the surface of photoreceptor drum 10 of K.

The aforesaid latent image is subjected to contact type reversal developing conducted by the developing unit 14 of K, and a toner image of black (K) is formed by rotation of photoreceptor drum 10 of K.

A toner image of K formed by the aforesaid image forming process on photoreceptor drum 10 of K representing an image forming body is transferred onto transfer belt 14*a* by primary transfer device 14*c* of K representing the first transfer means.

Then, the transfer belt 14*a* is synchronized with a toner image of C, and is given potential by image forming unit 100 of cyan (C) through charging operations of scorotron charger 11 of C, and image writing by electric signals corresponding to the second color signals, namely, to image data of C is conducted by exposure optical system 12 of C, thus, toner image of C formed on photoreceptor drum 10 of C by contact type reversal developing by developing unit 14 of C is transferred onto the aforesaid toner image of K to be superposed each other by the primary transfer device 14*c* of C representing the first transfer means in transfer area (having no sign) of C.

In the same process, synchronization is made with superposed toner images respectively of K and C, and, a toner image of M corresponding to image data of M by the third color signal which are formed on photoreceptor drum 10 of M by image forming unit 100 of magenta (M) is formed by primary transfer device 14*c* of M representing the first transfer means, in the transfer area of M (having no sign), to be superposed on the aforesaid toner images respectively of K and C, and further, synchronization is made with superposed toner images respectively of K, C and M, and, a toner image of Y corresponding to image data of Y by the fourth color signal which are formed on photoreceptor drum 10 of Y by image forming unit 100 of yellow (Y) is formed by primary transfer device 14*c* of Y representing the first transfer means, in the transfer area of Y (having no sign), to be superposed on the aforesaid toner images respectively of K, C and M, thus, a color toner image composed of superposed images respectively for K, C, M and Y is formed.

After-transfer remaining toner staying on a circumferential surface of photoreceptor drum 10 for each color after transfer is removed by cleaning device 190 representing a cleaning means for an image forming body for each color.

Recording sheet P is conveyed to transfer area (having no sign) of the second transfer device 14*g* representing the second transfer means from sheet cassette 15 representing a transfer sheet housing means through timing roller 16 that serves as a transfer sheet feeding means, in synchronization with forming of superposed color toner images on the transfer belt 14*a*, and superposed color toner images on the transfer belt 14*a* are transferred collectively onto recording sheet P by secondary transfer device 14*g* on which direct-current voltage having polarity opposite to that of toner (positive polarity in the present embodiment) is applied.

Recording sheet P onto which the color toner image has been transferred is neutralized electrically by neutralizing electrode 16*b* representing a separating means composed of a serrated electrode plate, and then, conveyed to fixing unit 17 where heat and pressure are applied to the recording sheet P in the place between fixing roller 17*a* and pressure roller 17*b* so that a toner image on the recording sheet P may be fixed, thus, the recording sheet P is ejected to a tray located outside the apparatus.

After-transfer remaining toner staying on a circumferential surface of the transfer belt 14*a* after transfer is removed for cleaning by cleaning device 190*a* representing a cleaning means for a transfer belt provided to face driven roller 14*e* with transfer belt 14*a* between, for cleaning.

Developing unit 14 representing a developing means for each color is provided with developing sleeve 141 that houses each two-component developer for each of yellow (Y), magenta (M), cyan (C) and black (K), and rotates in the rotation direction of photoreceptor drum 10 at the developing position while keeping a prescribed clearance from a circumferential surface of each photoreceptor drum.

Developing unit 14 representing a developing means for each color is of the structure identical to that explained with reference to FIG. 2, and developer D in hopper 200D is supplied to the developing unit 14 by rotation of supply roller SRD provided on the lower end of the hopper 200D. Further, the two-component developer ejected from the developing unit 14 is conveyed by conveyance screw 300B to be collected into developer collecting box 400. By controlling on the image forming apparatus having the structure mentioned above, by providing a carrier supply mode that supplies carrier to developing unit 14 in the course of printing operations, a developer supply mode that supplies developer to developing unit 14 before operations of the developing unit and/or a developer ejection mode that ejects developer from the developing unit after operations of the developing unit, it is possible to replace the two-component developer entirely, without dismounting the developing unit 14 from the image forming apparatus, which has made services by a serviceperson including replacement of developers unnecessary.

(Recording Material)

Recording materials used in the present invention are supports which hold toner images, and they are those called usually an image support, a transfer material or a transfer sheet. Specifically, there are given various transfer materials including an ordinary sheet including a thin sheet to a thick sheet, coated printing paper such as art paper and coated paper, Japanese paper and postcard paper which are on the market, plastic film for OHP and a textile, to which, however, the present invention is not limited.

EXAMPLES

Next, the present invention will be explained specifically, showing embodiments, however, the present invention is not limited thereto.

[Manufacturing of Toner]

(Manufacture of Resin Particles A)

First Step Polymerization:

Eight grams of dodecyl sodium sulfate and 3 liters of ion-exchange water were mixed in a reaction vessel with capacity of 5 liters on which a stirring device, a temperature sensor, a cooling tube and a nitrogen introduction device are mounted, and internal temperature in the vessel was raised up to 80° C. while stirring at the stirring speed of 230 rpm under a nitrogen flow. After raising temperature, added was 10 grams of potassium persulfate dissolved in 200 grams of ion-exchange water, and the temperature was raised to 80° C. again. Then, the following mixed liquid of monomers was dropped for a period of one hour, and the liquid was heated and stirred for 2 hours at 80° C. to conduct polymerization to prepare resin particles which was referred to as "resin particles (1H)".

| | |
|---|---|
| Styrene | 480 g |
| n-butylacrylate | 250 g |
| Methacrylic acid | 68.0 g |
| n-octyl-3-mercaptopropionate | 16.0 g |

Second Step Polymerization:

A solution of 7 grams of polyoxyethylene (2) dodecylether sodium sulfate dissolved in 800 ml of ion-exchange water was prepared in a reaction vessel with capacity of 5 L on which a stirring device, a temperature sensor, a cooling tube and a nitrogen introduction device were mounted, and the solution was heated up to 98° C. After that, 260 g of the aforesaid resin particles (1H) and a mixed liquid of the following monomers dissolved at 90° C. were added to the first solution, to be mixed and dispersed for one hour by a mechanical homogenizer CLEARMIX (manufactured by M TECHNIQUE Co., Ltd.) having a circulatory channel, thus, a dispersion liquid containing emulsified particles (oil drops) was prepared.

| | |
|---|---|
| Styrene | 245 g |
| n-butylacrylate | 120 g |
| n-octyl-3-mercaptopropionate | 1.5 g |
| Polyethylene wax (melting point ° C.) | 190 g |

Then, an initiator solution containing 6 g of potassium persulfate dissolved in 200 ml of ion-exchange water was added to the aforesaid dispersion liquid, which was, then, heated and stirred for one hour at 82° C. to conduct polymerization and thereby to obtain resin particles which was referred to as "resin particles (1HM)".

Third Step Polymerization:

A solution containing 11 grams of potassium persulfate dissolved in 400 ml of ion-exchange water was further added, and under the condition of a temperature of 82° C., a mixed liquid of the following monomers:

| | |
|---|---|
| Styrene | 435 g |
| n-butylacrylate | 130 g |
| Methacrylic acid | 33 g |
| n-octyl-3-mercaptopropionate | 8.0 g |

was dropped for a period of one hour. After the drop was completed, the mixture was stirred while heating at 82° C. for two hours to conduct polymerization, and then, cooling down to 28° C. to obtain resin particles, which is referred to as "resin particles A".

(Manufacture of Resin Particles B)

Some 2.3 grams of dodecyl sodium sulfate and 3 L of ion-exchange water were mixed in a reaction vessel with capacity of 5 L on which a stirring device, a temperature sensor, a cooling tube and a nitrogen introduction device were mounted, and internal temperature in the vessel was raised up to 80° C. while stirring at the stirring speed of 230 rpm under a nitrogen flow. After raising temperature, a solution of 10 grams of potassium persulfate dissolved in 200 grams of ion-exchange water was added and temperature was raised to 80° C. again, and the following monomer-mixed liquid was dropped for a period of one hour, then, the liquid was heated and stirred for 2 hours at 80° C. to conduct polymerization to prepare resin particles which was referred to as "resin particles B".

| | |
|---|---|
| Styrene | 520 g |
| n-butylacrylate | 210 g |
| Methacrylic acid | 68.0 g |
| n-octyl-3-mercaptopropionate | 16.0 g |

(Preparation of Colorant-Dispersed Solution)

Some 90 grams of dodecyl sodium sulfate was dissolved in ion-exchange water 1600 ml through stirring. While stirring this solution, 420 g of carbon black (Regal 330R: manufactured by Cabot Corp.) was added gradually, then, homogenizer CLEARMIX (manufactured by M TECHNIQUE Co., Ltd.) was used for dispersion processing to prepare a dispersion liquid of colorant particles which was referred to as "colorant-dispersed liquid 1". The particle diameter of colorant particles in this colorant-dispersed liquid 1 was measured by an electrophoresis light-scattering photometer "ELS-800" (manufactured by Otsuka Electronics Co., Ltd.) to prove to be 110 nm.

(Coagulation•Fusion Process)

A liquid containing 300 g of resin particles A in solid-content-conversion, 1400 g of ion-exchange water, 120 g of "colorant-dispersed solution 1", and 3 grams of polyoxyethylene (2) dodecylether sodium sulfate dissolved in 120 ml of ion-exchange water was installed in a reaction vessel with capacity of 5 L on which a stirring device, a temperature sensor, a cooling tube and a nitrogen introduction device are mounted, and the solution temperature was adjusted to 30° C., and then, sodium hydroxide solution of 5 mol/L was added to adjust pH to 10. After that, a solution of 35 g of magnesium chloride dissolved in 35 ml of ion-exchange water was added at 30° C. while stirring, for over 10 minutes. After holding the solution for 3 minutes, temperature was raised to 90° C. for over 60 minutes, and reaction of particle growth was continued while keeping 90° C.

Under this condition, a particle diameter of association particles was measured by "Coulter multisizer III", then, 260 g of resin particles B were added at the moment when the volume median diameter reached 3.1 μm, and reaction of particle growth was further continued. At the point when a desired particle diameter was acquired, a solution of 150 g of sodium chloride dissolved in 600 ml of ion-exchange water was added to stop the growth of particles, and further, heating and stirring were carried out at the liquid temperature of 98° C. as a fusion process to advance fusion of particles until the degree of circularity measured by FPIA-2100 became 0.965. After that the liquid temperature was reduced to 30° C. and hydrochloric acid was added to adjust pH to 4.0, and stirring was stopped.

(Washing•Drying Process)

Particles generated by the coagulation•fusion process were subjected to solid-liquid separation conducted by a centrifugal separator of a basket type "MARKIII, Model number 60×40" (manufactured by MATSUMOTO MACHINE Co. Ltd.), and a wet cake of base particle for toner was formed. The wet cake was washed by ion-exchange water at 45° C. until the electric conductivity of a filter liquid becomes 5 μS/cm, in the aforesaid centrifugal separator of a basket type, and then, was moved to "a flash jet dryer" (manufactured by Seishin Enterprise Co., Ltd.) to be dried until the moisture content becomes 0.5% by weight, thus, base particles for toner were prepared.

(Preparation of Toner Particles)

To the base particles for toner prepared in the foregoing, there were added 1.0% by weight of hydrophobic silica (number average primary particle diameter: 12 nm) and 0.6% by weight of hydrophobic titania (number average primary particle diameter: 20 nm) to be mixed together by Henschel mixer, and thus toner A of the present invention was prepared. The surface area ratio of element (A) for toner A determined by an X-ray analysis apparatus was 3.0 area %.

Further, to the base particles for toner, there were added 1.0% by weight of hydrophobic silica (number average primary particle diameter: 12 nm) and 0.8% by weight of hydrophobic titania (number average primary particle diameter: 30 nm) to be mixed together by Henschel mixer, and thus toner B of the present invention was prepared.

Further, to the base particles for toner, there were added 1.0% by weight of hydrophobic silica (12 nm) and 0.5% by weight of alumina (30 nm) to be mixed together by Henschel mixer, and thus toner C of the present invention was prepared.

[Preparation of Carrier]

(Preparation of Carrier Core)

The raw material oxides of the ferrite compound were added so that the ratio of $Fe_2O_3$:MgO is 60:40 in mol %, and thereby, a composite was prepared. To the composite, there were added 1 weight % of binder and water, to make a slurry having a solid concentration of 60 weight % which was ground by a wet type ball mill, and was processed by a spray dryer, thus, dry particles having an average particle diameter of 35 μm were obtained. Then, the dry particles were calcined at 1150° C. under an ambient atmosphere in a calcination furnace, and ferrite core particles were obtained through pulverizing and sifting the particles.

In the same way, pulverizing conditions were adjusted, and core particles having the particle diameters shown in Table b 1 were obtained.

(Preparation of Resin Coated Carrier)

Some 100 weight parts by weight of the ferrite core particles and 5 weight parts by weight of copolymer resin particles of cyclohexylmethcrylate/methylmethacrylate (copolymerization ratio of 5/5) were put in a high speed mixer having a stirring blade, to be stirred and mixed for 30 minutes at 120° C., and a resin coated layer was formed on the surface of a ferrite core particle by an action of mechanical impulsive force, thus, carrier was obtained.

(Preparation of Developers)

Starter developers for starting operations were prepared by mixing the carrier particles described in Table 1 with corresponding particles described in Table 1. Each mixture was installed in a micro-type V-mixer (manufactured by TSUTSUI RIKAGAKU Co. Ltd.) and mixed for 30 minutes at a rotating speed of 45 rpm. Subsequently, corresponding toner was added so that toner concentration was 8% by weight, and further mixed for 30 minutes to obtain each developer.

Developers for replenishing were prepared by using the carriers in which corresponding particles were mixed as described above. In each carrier, corresponding toner was added so that the toner concentration was 75% by weight, and further mixed to obtain each developer.

Incidentally, the determination of the area ratio of element (A) of each carrier was carried out by removing toner particles from the developer prepared by using the carrier and by measuring the element amount on the carrier surface to btain the area ratio.

TABLE 1

| | Toner | Area % of element (A) in toner TA | Carrier Core particle diameter (μm) | Particle to be added to carrier: Inorganic particle to be added | Particle to be added to carrier: Added amount (% by weight) | Particle to be added to carrier: Area % of element (A) in carrier CA | TA/CA | tA/cA |
|---|---|---|---|---|---|---|---|---|
| Developer 1 | A | 3.0 | 35 | Titania | 0.02 | 1.0 | 3.0 | 30 |
| Developer 2 | A | 3.0 | 35 | Titania | 0.005 | 0.5 | 6.0 | 120 |
| Developer 3 | A | 5.7 | 35 | Silica | 0.04 | 1.9 | 3.0 | 25 |
| Developer 4 | A | 3.0 | 35 | Titania | 0.15 | 3.0 | 1.0 | 4 |
| Developer 5 | B | 4.5 | 20 | Silica | 0.02 | 0.9 | 5.0 | 50 |
| Developer 6 | A | 3.0 | 40 | Titania | 0.02 | 1.1 | 2.7 | 30 |
| Developer 7 | C | 4.5 | 40 | Alumina | 0.01 | 0.5 | 9.0 | 50 |
| Comparative Developer 1 | A | — | 15 | — | 0 | — | — | — |
| Comparative Developer 2 | A | — | 50 | — | 0 | — | — | — |
| Comparative Developer 3 | A | 3.0 | 35 | Titania | 0.003 | 0.3 | 10 | 200 |
| Comparative Developer 4 | A | 3.0 | 30 | Titania | 0.14 | 3.5 | 0.9 | 4 |

(Amount of Electrification)

The amount of electrification of toner in developer sample of the present invention was measured by measuring device for amount of electrification "TB-200 of a blow-off type" (manufactured by TOSHIBA CORPORATION)

In the blow-off type electrification amount measuring device equipped with a stainless steel screen of 400 mesh (for example, TB-200: manufactured by KYOCERA Chemical Corp.), nitrogen gas was blown for 10 seconds under the condition of a blowing pressure of 50 kPa. The amount of electrification (μC/g) was calculated by dividing the electric charge obtained through measurement by mass of the toner that was blown off.

[Evaluation of Practical Images]

(Photographic fog Evaluation)

Each developer obtained in the foregoing was loaded in an image forming apparatus equipped with a developing unit shown basically in FIG. 2 and has the structure shown in FIG. 4, and conducted was image forming of 100,000 sheets in which solid images of half-size of a A4 sized paper which consume a large amount of toner were included intermittently on every second sheets, under the ambient conditions of temperature: 25° C., and relative humidity: 50% RH.

With respect to measurement of fog density, 20 locations on a white sheet on which no printing has been made are measured in terms of absolute image density by Macbeth reflection densitometer "RD-918", and results of the measurement are averaged to be white sheet density.

Next, 20 locations of white areas on the printed sheet were measured in the same way in terms of absolute image density for 50000th and 60000th images which were formed for evaluation, and a value obtained by subtracting white sheet density from the average density was evaluated as fog density. If fog density is 0.010 or less, the fog is recognized not to be problematic for practical use.

A: Less than 0.003

B: 0.003-less than 0.006

C: 0.006-0.010 or less

D: Larger than 0.010

(Image Density)

Solid black images thus outputted were measured by reflection densitometer RD-918 manufactured by GRETAG MACBETH.

Image density is an absolute density, and criteria for evaluation are as follows.

A: Image density of solid black image is 1.2 or more

B: Image density of solid black image is 1.1 or more and less than 1.2

C: Image density of solid black image is 1.0 or more and less than 1.1

D: Image density of solid black image is less than 1.0

TABLE 2

| | At the start: *1 (μC/g) | At the start: Area ratio (%) of element (A) CA | At the start: *2 | At the start: Image density | After 100,000 sheets printing: *1 (μC/g) | After 100,000 sheets printing: Surface ratio (%) of element (A) CA | After 100,000 sheets printing: *2 | After 100,000 sheets printing: Image density |
|---|---|---|---|---|---|---|---|---|
| Developer 1 | 45 | 1.0 | A | A | 42 | 1.2 | A | A |
| Developer 2 | 50 | 0.5 | A | B | 45 | 0.8 | B | A |
| Developer 3 | 38 | 1.9 | A | A | 36 | 1.9 | A | A |
| Developer 4 | 29 | 3.0 | B | A | 32 | 2.0 | B | A |
| Developer 5 | 54 | 0.9 | A | B | 53 | 1.1 | B | B |
| Developer 6 | 37 | 1.1 | A | A | 38 | 1.3 | A | A |
| Developer 7 | 35 | 0.5 | B | A | 30 | 1.5 | B | B |
| Comparative Developer 1 | 60 | 0.1 | B | D | 37 | 1.5 | D | D |
| Comparative Developer 2 | 45 | 0.1 | B | A | 26 | 1.2 | D | D |
| Comparative Developer 3 | 65 | 0.3 | B | D | 40 | 1.0 | D | D |
| Comparative Developer 4 | 25 | 3.5 | C | B | 28 | 2.0 | D | B |

*1: Amount of electrification,

*2: Fog evaluation

Table 2 above shows that the developers of the present invention exhibit excellent characteristics for a long period of time including the initial stage and after used for a long time.

What is claim is:

1. A method to form an image using a trickle developing system comprising the steps of:

(i) forming an electrostatic latent image on a photoreceptor;

(ii) developing the electrostatic latent image with a developer to form a toner image using the trickle developing system, a mixture of a toner and a carrier being refilled to a developing device in the trickle developing system when an amount of toner is decreased to a prescribed level; and (iii) transferring the toner image onto a recording sheet, wherein (a) the toner comprises colorant particles with a volume median diameter of 3 to 8 μm having first inorganic particles on surfaces of the colorant particles to form toner particles;

(b) the carrier comprises magnetic particles with a weight average particle diameter (D4) of 20 to 40 μm having second inorganic particles on surfaces of the magnetic particles to form carrier particles; and (c) an area ratio of element (A) based on a total area of surfaces of the carrier particles is 0.5 to 3.0 area % determined by using an X-ray analysis, provided that element (A) represents one or more elements commonly contained in the first inorganic particles and in the second inorganic particles.

2. The method of claim 1, wherein element (A) is titanium.

3. The method of claim 1, wherein an area ratio of element (A) based on a total area of surfaces of the toner particles, TA, and an area ratio of element (A) based on the total area of the surfaces of the carrier particles, CA, meet the following relationship, $$1 \leqq TA/CA \leqq 8.$$

4. The method of claim 1, wherein an amount of inorganic particles containing element (A) in the toner particles, tA (weight % based on the weight of the colorant particles), and an amount of inorganic particles containing element (A) in the carrier particles, cA (weight % based on the weight of the magnetic particles), meet the following relationship, $$5 \leqq tA/cA \leqq 80.$$

5. A method to prepare a developer used in the method of claim 4 comprising the steps of:

(i) preparing a carrier by adding 0.005 to 0.05 weight % of inorganic particles containing element (A) based on a weight of the magnetic particles;

(ii) preparing a toner by adding 0.1 to 1.0 weight % of inorganic particles containing element (A) based on a weight of the colorant particles; and (iii) mixing the carrier prepared in step (i) and the toner prepared in step (iii) to form the developer.

* * * * *